US010252147B2

(12) United States Patent
Shigeta

(10) Patent No.: US 10,252,147 B2
(45) **Date of Patent: *Apr. 9, 2019**

(54) SYSTEM FOR MANAGING PACKAGES OF SHUFFLED PLAYING CARDS

(71) Applicant: ANGEL PLAYING CARDS CO., LTD., Shiga (JP)

(72) Inventor: Yasushi Shigeta, Shiga (JP)

(73) Assignee: ANGEL PLAYING CARDS CO., LTD., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/128,651

(22) PCT Filed: Oct. 20, 2014

(86) PCT No.: PCT/JP2014/005320

§ 371 (c)(1),
(2) Date: Sep. 23, 2016

(87) PCT Pub. No.: WO2015/145499

PCT Pub. Date: Oct. 1, 2015

(65) Prior Publication Data

US 2017/0106270 A1 Apr. 20, 2017

(30) Foreign Application Priority Data

Mar. 24, 2014 (AU) ..... 2014201757

(51) Int. Cl.
*A63F 1/12* (2006.01)
*A63F 1/06* (2006.01)
(Continued)

(52) U.S. Cl.
CPC ..... *A63F 1/062* (2013.01); *A63F 1/06* (2013.01); *G07F 17/322* (2013.01);
(Continued)

(58) Field of Classification Search
CPC .. A63F 1/06; A63F 1/062; A63F 2003/00164; A63F 2009/2425; A63F 11/00; A63F 2009/2439; A63F 1/12
(Continued)

(56) References Cited

U.S. PATENT DOCUMENTS 5,282,679 A 2/1994 Redelinghuys
6,600,418 B2 7/2003 Francis et al. ..... 340/572.1
(Continued)

FOREIGN PATENT DOCUMENTS

AU 2011294601 A1 1/2013
AU 2017204645 A1 7/2017
(Continued)

OTHER PUBLICATIONS

Japanese Office Action, Japanese Patent No. 2016509612, dated May 30, 2017.
(Continued)

*Primary Examiner* — Benjamin Layno
(74) *Attorney, Agent, or Firm* — Norton Rose Fulbright US LLP

(57) ABSTRACT

The present invention provides a system having: packages (2) of shuffled playing cards (1*s*) in which playing cards included are shuffled in random order and are individually packed in one package (2), and in which a unique ID code (4) is attached to each unique package (2); a game table (11); a storage box (401) that is installed beside the game table (11), stores the plurality of packages (2), includes a reader (451) that reads the ID codes (4) of all the packages (2), and includes an openable lid (452*a*, 452*b*) so that the packages can be taken out one by one; and a control device (112) for monitoring whether or not the packages (2) are present in the
(Continued)

storage box (401) by monitoring the ID codes (4) of the packages (2) read by the readers (451), and for outputting monitoring results.

18 Claims, 15 Drawing Sheets

(51) Int. Cl.
*G07F 17/32* (2006.01)
*A63F 11/00* (2006.01)
*A63F 3/00* (2006.01)
*A63F 9/24* (2006.01)

(52) U.S. Cl.
CPC ..... *G07F 17/3241* (2013.01); *G07F 17/3293* (2013.01); *A63F 1/12* (2013.01); *A63F 11/00* (2013.01); *A63F 2003/00164* (2013.01); *A63F 2009/242* (2013.01); *A63F 2009/2439* (2013.01); *A63F 2250/24* (2013.01)

(58) Field of Classification Search
USPC ..... 273/309, 148 R, 149 R, 149 P
See application file for complete search history.

(56) References Cited

U.S. PATENT DOCUMENTS

| | | | | |
|---|---|---|---|---|
| 6,621,053 | B1 * | 9/2003 | Wensink | A47J 37/0694 126/337 R |
| 7,055,690 | B1 | 6/2006 | Valdez et al. | |
| 7,108,606 | B1 * | 9/2006 | Luciano | G07F 17/3216 361/679.57 |
| 8,192,278 | B2 | 6/2012 | Yoshizawa | |
| 8,387,983 | B2 | 3/2013 | Shigeta | |
| 2003/0195025 | A1 * | 10/2003 | Hill | A63F 1/18 463/11 |
| 2005/0026683 | A1 | 2/2005 | Fujimoto | |
| 2005/0137005 | A1 | 6/2005 | Soltys | |
| 2005/0288083 | A1 | 12/2005 | Downs, III | |
| 2007/0024449 | A1 * | 2/2007 | Bilyeu | G06K 17/00 340/573.1 |
| 2008/0174423 | A1 | 7/2008 | Breed | |
| 2010/0314834 | A1 | 12/2010 | Shigeta | |
| 2010/0327525 | A1 | 12/2010 | Shigeta | |
| 2011/0127722 | A1 | 6/2011 | Emori et al. | |
| 2011/0130185 | A1 | 6/2011 | Walker | |
| 2013/0161905 | A1 | 6/2013 | Grauzer et al. | |
| 2013/0292902 | A1 | 11/2013 | Shigeta | |
| 2014/0033660 | A1 | 2/2014 | Shigeta | |
| 2015/0042042 | A1 * | 2/2015 | Shigeta | A63F 1/062 273/148 R |
| 2015/0136562 | A1 | 5/2015 | Fujita et al. | |

FOREIGN PATENT DOCUMENTS

| | | | |
|---|---|---|---|
| CN | 1890004 | A | 1/2007 |
| CN | 101873880 | | 10/2010 |
| CN | 102125756 | | 7/2011 |
| CN | 102307633 | | 1/2012 |
| CN | 103170132 | A | 6/2013 |
| EP | 2228106 | A1 | 9/2010 |
| FR | 1116180 | A | 5/1956 |
| JP | 2004-299878 | A | 10/2004 |
| JP | 2005046621 | A | 2/2005 |
| JP | 2007-167248 | A1 | 7/2007 |
| JP | 2007213105 | | 8/2007 |
| JP | 2008081238 | | 4/2008 |
| JP | 201124603 | A | 2/2011 |
| JP | 2011098831 | | 5/2011 |
| JP | 2011115266 | A | 6/2011 |
| JP | 2012144855 | A | 2/2012 |
| JP | 201431217 | A | 2/2014 |
| WO | 2009126780 | A2 | 10/2009 |
| WO | 2010055328 | A1 | 5/2010 |
| WO | 2013/172083 | A1 | 11/2013 |
| WO | 2013172038 | A1 | 11/2013 |
| WO | 2015019619 | A1 | 2/2015 |

OTHER PUBLICATIONS

International Search Report, International Application No. PCT/JP2014/005320, dated Dec. 9, 2014.
New Zealand First Examination Report, NZ Application No. 724658, dated Feb. 7, 2017.
Singapore Office Action, Singapore Application No. 10201404777Q, dated Feb. 8, 2017.
European Patent Application No. 14887421.7, Search Report dated Dec. 1, 2017.
U.S. Appl. No. 14/455,241, Final Office Action dated Dec. 29, 2017.
Korean Office Action, Korean Application No. 10-2016-7023313, dated Nov. 6, 2017.
Notice of 1st Office Action on CN Patent Application No. 201480044891.9, dated May 4, 2018.
European Search Report on EP Patent Application No. 18153556.8, dated May 14, 2018.
Office Action on JP Patent Application No. 2017-124693, dated Jun. 26, 2018.
Notice of Allowance on JP Patent Application No. 2014-162833, dated Mar. 6, 2018.
Rejection on KR Patent Application No. 10-2016-7023313, dated Apr. 25, 2018.
Office Action on JP2016-509612, dated Feb. 27, 2018.
Further Examination Report on NZ Patent Application No. 735826, dated Oct. 12, 2018.
Examination Report No. 3 on AU Patent Application No. 2017204645, dated Jan. 29, 2019.

* cited by examiner

SYSTEM FOR MANAGING PACKAGES OF SHUFFLED PLAYING CARDS

CROSS REFERENCE TO RELATED APPLICATIONS

This application is a National Phase application under 35 U.S.C. § 371 of PCT Application PCT/JP2014/005320, filed Oct. 20, 2014, which application claims priority benefit to Australian Application No. 2014201757, filed Mar. 24, 2014, which applications are hereby incorporated by reference.

TECHNICAL FIELD

The present invention relates to a system for managing packages of shuffled playing cards for preventing loss or replacement of the packages of the cards while casinos using the packages of a number of cards are operated, in the casinos, and card game facilities using other card game tables.

BACKGROUND ART

There are baccarat and blackjack in a number of live table games performed in casinos or game facilities. In these games, standard decks each including fifty-two playing cards are used, and the cards are usually distributed from a shooter including the plurality of decks (six to nine or ten decks) shuffled in accordance with the start of play. When an operator (hereinafter described as a "dealer (D)") of a casino distributes playing cards to a game table in order to use them in such a game, a result of the game is decided by arrangement of the cards of the plurality of decks from the shooter (a winner or a victor). Before the casino uses these packages for such a purpose, game cards of a predetermined number of decks are shuffled in random order (arrangement), and are individually packed in one package.

Shortage and exchange of the cards must not occur in the casino. This is because when someone reads arrangement of the cards included in the package, and returns the package to the casino, he can predict a result of a game at the time of the dealer (D) using the read package.

In order to ensure a fair game by preventing the shortage and exchange of the packages of the shuffled game cards in the casino, the casino manages the packages of the shuffled game cards, and appropriately performs the game at the table (i.e., exchange of the packages of the shuffled game cards, other unexpected or unauthorized acts, etc. are eliminated). Packages of shuffled game cards are well-known, and are disclosed in Patent Literature 1 (US Patent Application Publication No. 2010/0327525).

CITATION LIST

Patent Literature

[Patent Literature 1]
US Patent Application Publication No. 2010/0327525

SUMMARY OF INVENTION

Technical Problem

The present invention provides monitoring packages of shuffled game cards of a casino in real time, in which the casino can immediately cancel a game when something unpredictable occurs by managing all the packages of the shuffled game cards present in the casino. A reason why the management is important is that if the shuffled playing cards on a table are the ones lost once in the casino, someone may know arrangement thereof.

The present invention has been made to solve the above-described problem, and to provide a system for monitoring packages of shuffled game cards for a casino to stop the package of some sort of suspicious shuffled game cards in the casino by managing all the packages of the shuffled game cards in the casino.

Solution to Problem

In order to solve the above-described conventional problem, the present invention provides a system for managing packages of shuffled playing cards, the system having: packages of shuffled playing cards in which playing cards included in a predetermined number of decks are shuffled in random order and are individually packed in one package, and in which a unique ID code is attached to each unique package of the shuffled playing cards; a game table at which a game is performed using the shuffled playing cards; a storage box that is installed beside the game table, stores the plurality of packages, includes one or more readers that read the ID codes of all the packages, and includes an openable lid so that the packages can be taken out one by one; and a control device for monitoring whether or not the packages are present in the storage box by monitoring the ID codes of the packages read by the readers, and for outputting monitoring results.

In addition, the present invention provides packages of shuffled playing cards for being used in the above-described system.

In order to solve the above-described conventional problem, the present invention provides a storage box that stores packages of shuffled playing cards and monitors ID codes attached to the packages, the storage box having: a storage box that stores the plurality of packages, includes one or more readers that read the ID codes of all the packages, and includes an openable lid so that the packages can be taken out one by one; and a control device for monitoring whether or not the packages are present in the storage box by monitoring the ID codes of the packages read by the readers, and for outputting monitoring results.

As is explained hereinafter, there are other aspects in the present invention. Accordingly, disclosure of the present invention is intended to provide some aspects of the present invention, and is not intended to limit the scope of the invention described and claimed here.

DESCRIPTION OF EMBODIMENT

Details of the present invention will be explained hereinafter. However, the following detailed explanation and accompanying drawings do not limit the invention.

Explanation of Preferred Embodiment

Example 1

Figure 1:
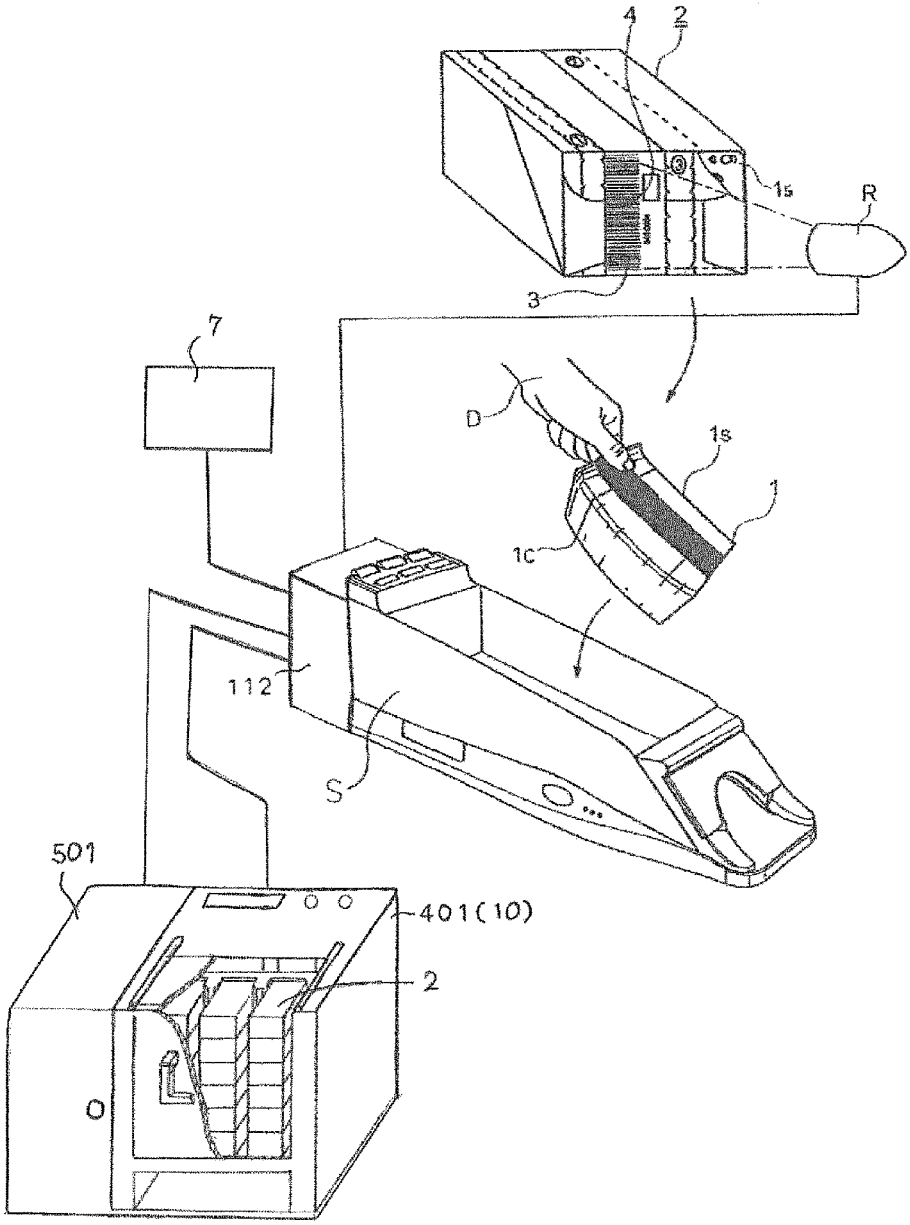
FIG. 1 is a perspective view of a package, and shuffled playing cards from which packaging has been removed, which are used for a card shooter device of a system for managing the packages of the shuffled playing cards of an embodiment of the present invention.
Figure 2A:
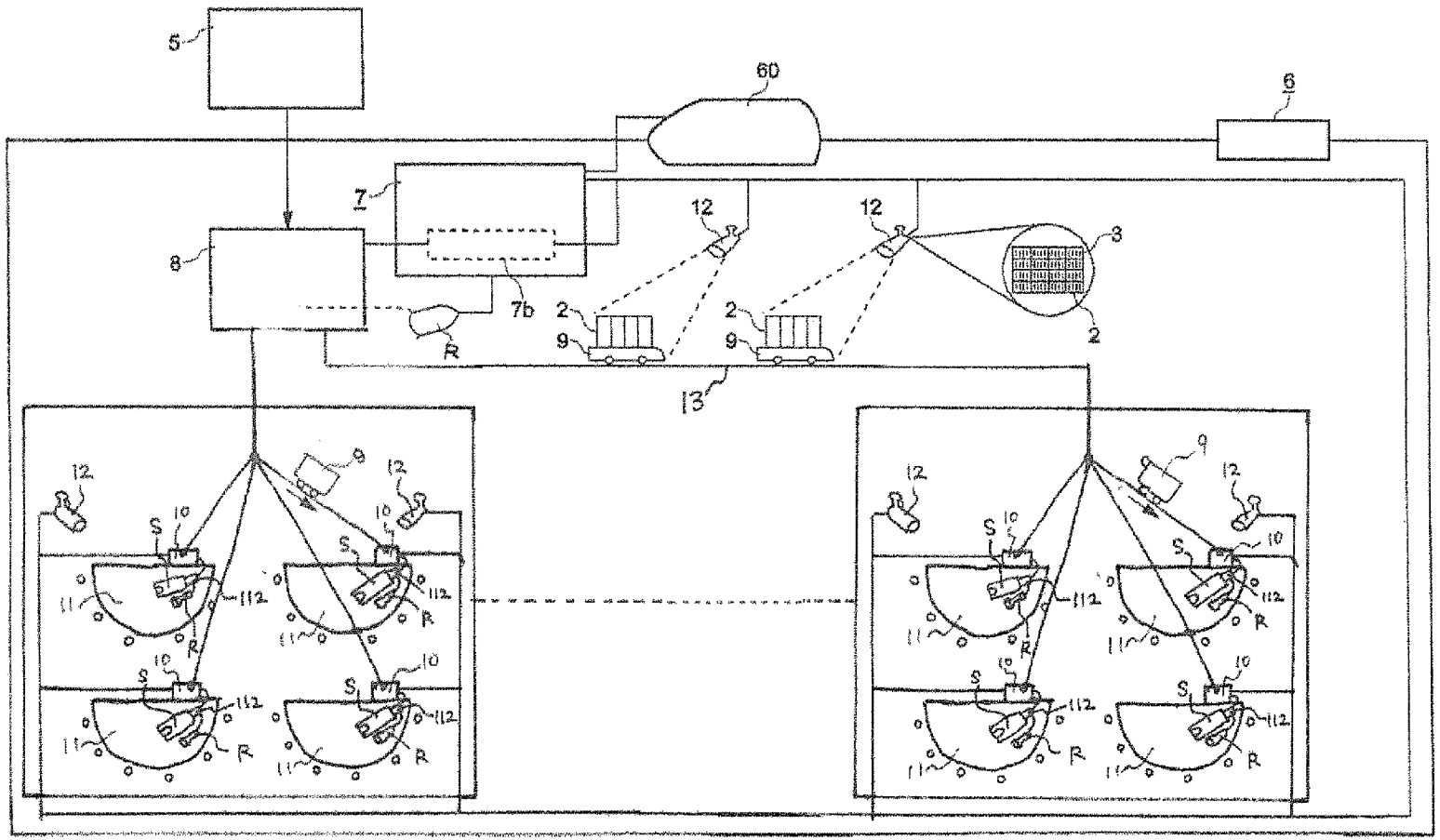
FIG. 2*a* is a diagram showing an outline of a whole system for managing the packages of the shuffled playing cards of the embodiment of the present invention.

An embodiment of a system for managing a package 2 of shuffled playing cards 1*s* will be explained hereinafter. FIG. 1 is a perspective view of: the package 2 of the shuffled playing cards 1*s*; a reader R that reads a bar code 3 (as an ID code 4) of the package 2 of the shuffled playing cards 1*s*; a card shooter device S used in a table game in a casino; and a storage box that manages the after-mentioned package 2 of the shuffled playing cards 1*s*. FIG. 2*a* is a diagram showing an outline of a whole system for managing packages of shuffled playing cards of the embodiment of the present invention.

The respective shuffled playing cards 1*s* include a predetermined number of decks (usually, six, eight, nine, or ten decks), are shuffled in random order and arranged in unique and random arrangement order, and are packed so as to be the package 2 to which a uniquely identifiable shuffle card ID (the bar code 3, a RFID tag, or the like) has been attached as the ID code 4 in a factory 5. In this example, the ID code 4 is attached to the package 2 in a form of the bar code 3 (a two-dimensional code as a QR Code (registered trademark) may be employed) read by the bar code reader R and the other RFID tag reading means (not shown) of the card shooter device S, or in a form, such as the RFID tag. The package 2 is sealed by a sealing material or a shrink packaging material at the factory 5.

A management control device 7 in a casino 6 is used to manage whether or not the package 2 is lost, or whether or not the number of the packages 2 is more increased than the number of packages 2 accepted in a backyard 8 of the casino 6. If the package 2 is lost or missing, in order to win a game, the following acts may be performed: someone tears the package 2 to then read order of cards in the package 2; he mixes his own cards in the cards in the package 2; or he exchanges several cards in the package 2 so that the cards distributed to himself are previously arranged in certain arrangement, and returns the package used at the game table to a pit or the table of the casino. In order to solve the above-described problem, there is provided a system for managing or monitoring the packages 2 of all the shuffled playing cards in the casino 6 using the management control device 7.

The packages 2 to which the bar codes 3 have been attached as the unique ID codes are supplied to the backyard 8 of the casino 6. All the ID codes 4 of the packages 2 carried to the backyard 8 are registered in a database 7*b* (a memory etc.) of the management control device 7 (as a registration step of registering all the ID codes 4 in the database). All the ID codes 4 (the bar codes 3 (they may be two-dimensional codes as QR Codes)) of the packages 2 carried to the backyard 8 at this stage are registered to create a basic database. In order to register all the ID codes of the packages 2 supplied to the casino 6, data from the factory, an after-mentioned carton ID code 30, or an after-mentioned pallet ID 40 may be used instead of reading all the bar codes 3 of the packages. In carrying-out of the present invention, a camera 12 or an RFID tag reading device (not shown) may be used instead of a bar code reader (not shown) in order to register or read the ID code 4. The packages may be carried from the factory etc. as a carton CA in a state where eighteen packages of the shuffled playing cards 1*s* (refer to FIG. 3) are present (several cartons CA may be put on a pallet PA). The carton ID code 30 or the pallet ID 40 may be used to register the ID codes of the packages 2 carried to the backyard 8 from the factory 5.

Figure 3:
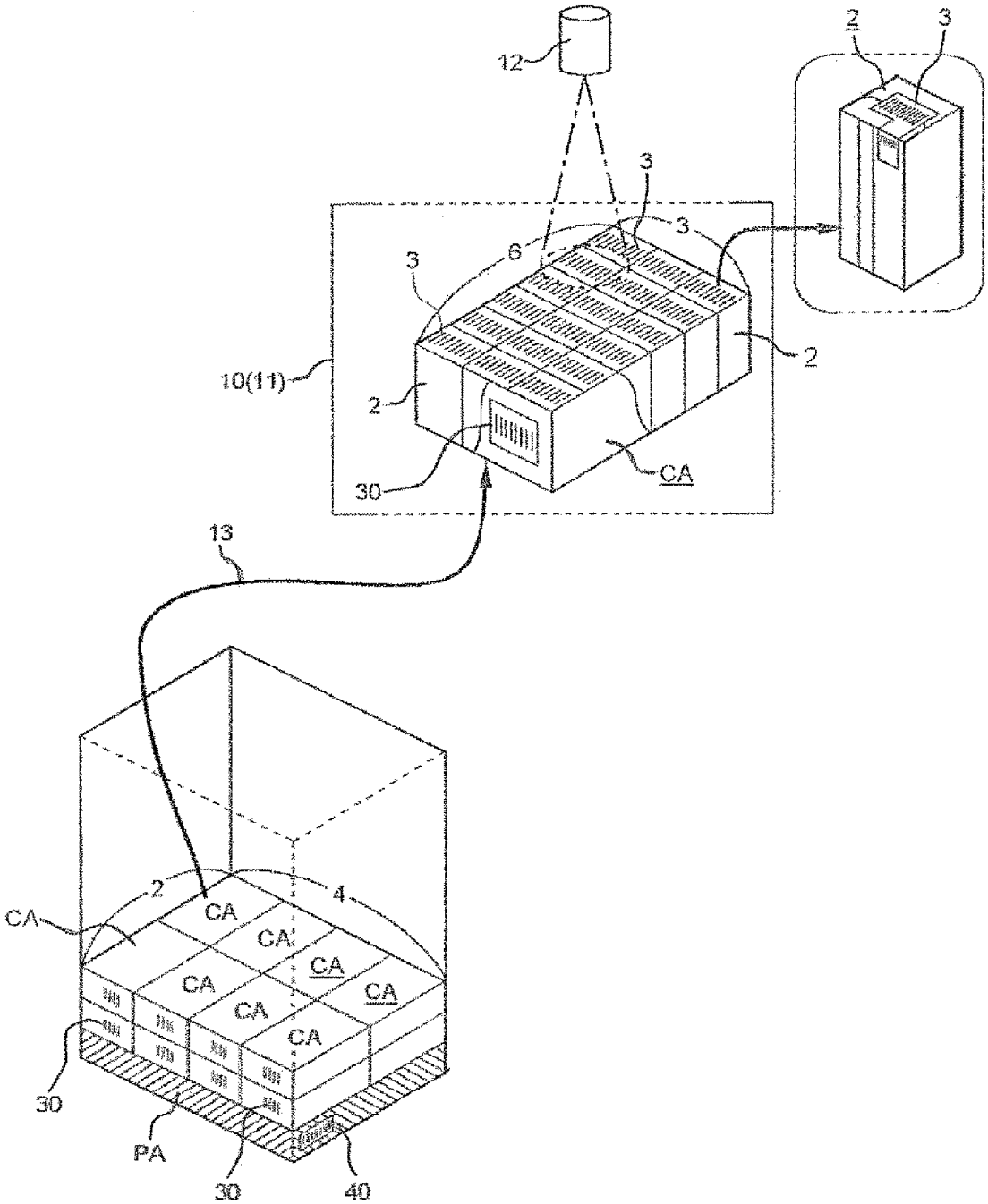
FIG. 3 is a perspective view showing that the shuffled playing cards of one of the embodiments of the present invention are carried to the backyard and a pit of a casino table from a factory in a form of being loaded as the packages, in the cartons, and on a pallet.
Figure 4:
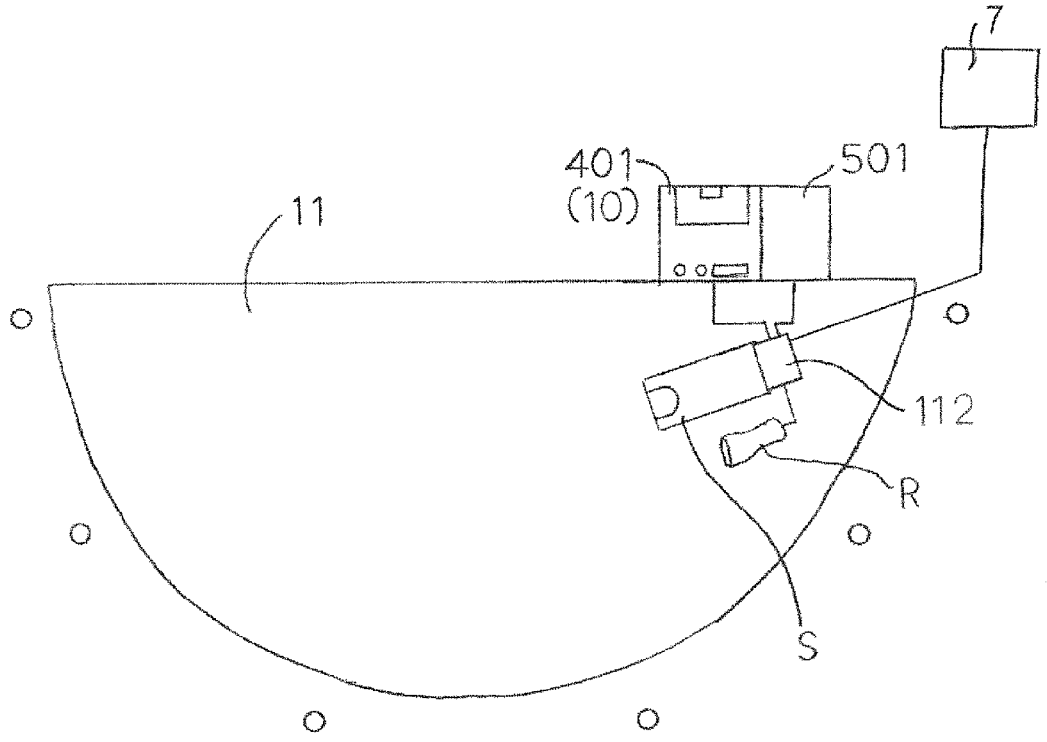
FIG. 4 is a plan view of a table and a storage box of the embodiment of the present invention.

The packages 2 each with the bar codes 3 are stored in the cartons CA while being carried to the casino 6, the cartons CA are put on the pallet PA, and then the packages 2 are stored in the backyard 8 (refer to FIG. 3). The unique carton ID code 30 is attached to each carton CA, and the unique pallet ID 40 is attached to each pallet PA. The carton ID code 30 is associated with the ID codes of the packages stored in the carton CA, and is previously registered in the database 7*b* of the management control device 7. The pallet ID 40 is associated with the corresponding carton ID code 30 on the pallet PA and the ID codes 4 of the packages 2 stored in the carton CA, and is previously registered in the database 7*b* of the management control device 7. All the ID codes 4 of the packages 2 are associated with the carton ID code 30 of the carton CA in which the packages 2 have been stored, and the pallet ID 40.

Figure 2B:
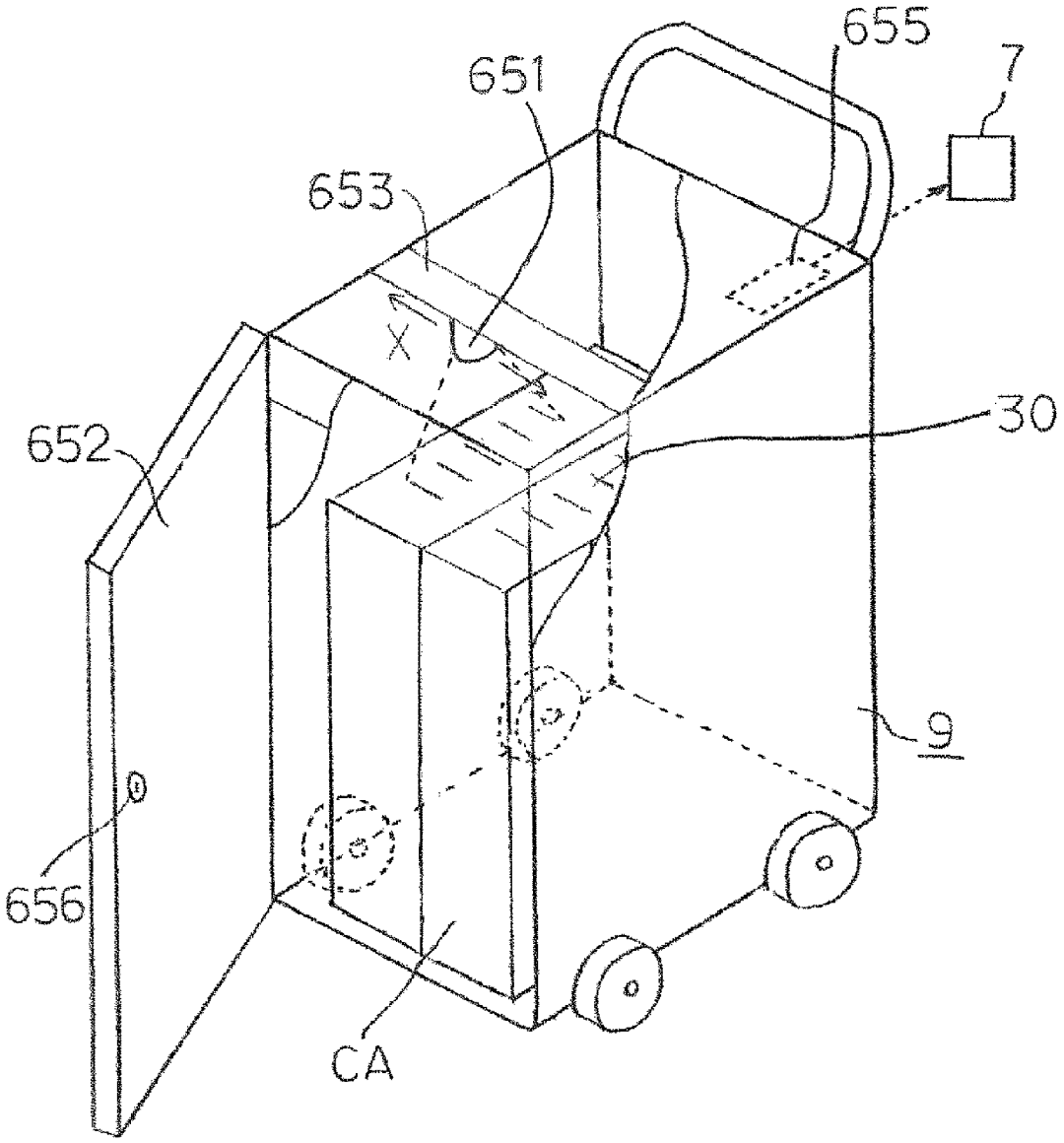
FIG. 2*b* is a perspective view showing a trolley for carrying the packages of the shuffled playing cards of one of the embodiments of the present invention from a backyard to a game table pit in a state where the packages are stored in cartons.

The packages 2 are usually carried to a game table pit 10 from the backyard 8 by a plurality of trolleys 9 while they are stored in the cartons CA (refer to FIG. 2*b*), are taken out from the cartons CA in the game table pit 10, are stored for a certain period, and subsequently, the packages 2 are manually taken out from the game table pit 10 by a dealer (D) etc., are put on the game table 11, and are used at the game table. The ID codes 4 of all the packages of the shuffled playing cards (or the carton ID codes 30 of the cartons CA in which the packages 2 are stored) are read by the camera 12 or bar code readers 451, 551, 651, and 751 at a predetermined place, and thereby all the packages 2 (or the cartons CA in which the packages 2 are stored) present in the casino 6 are monitored. The monitoring camera 12 is arranged or installed in order to be able to read from the backyard 8 the bar codes 3 (as the ID codes) of all the existing packages 2 of the shuffled playing cards present in the game table pit 10 (or the carton ID codes 30 of the cartons CA in which the packages 2 are stored).

Figure 2C:
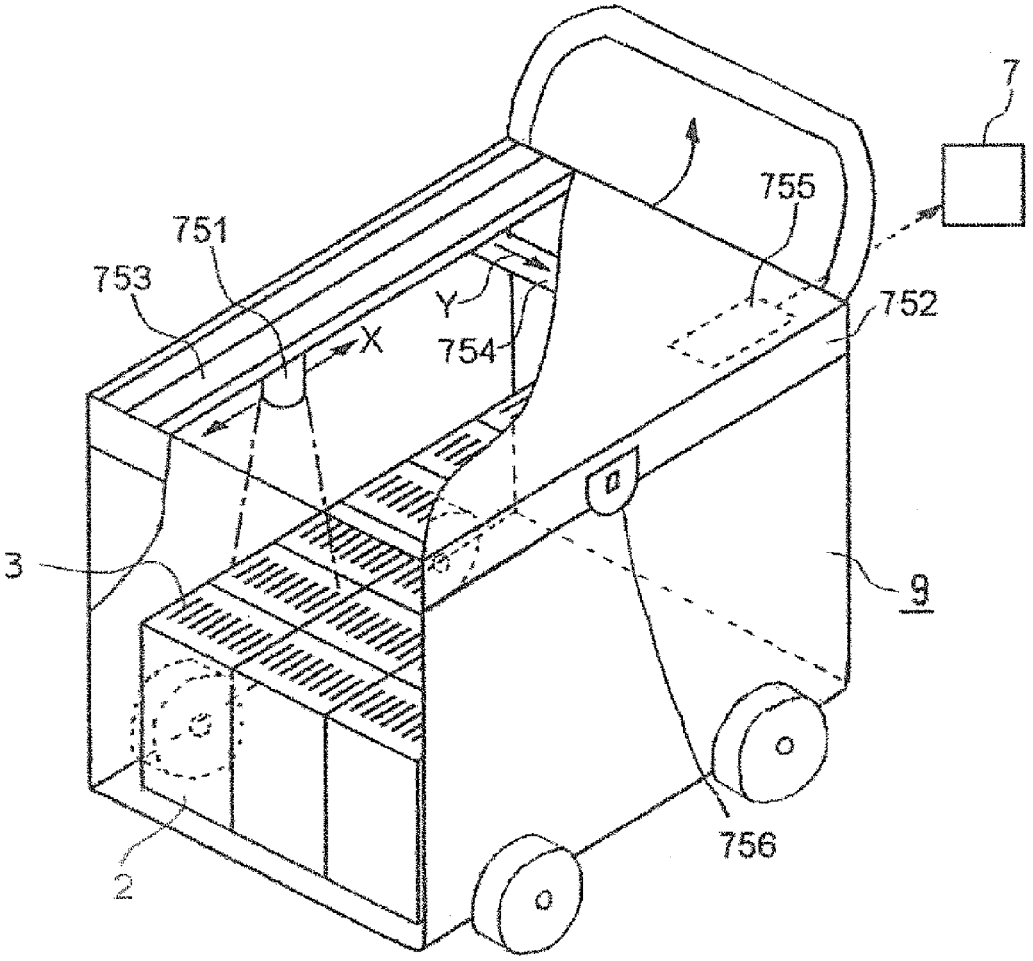
FIG. 2*c* is a perspective view showing a trolley for carrying the packages of the shuffled playing cards of one of the embodiments of the present invention from the backyard to the game table pit.

In the carrying-out of the present invention, the trolley 9 carries the packages 2 of the shuffled playing cards 1*s* used for a game from the backyard 8 to the game table pit 10. In addition, a plurality of AGVs (automatic conveying vehicles) may be used as the trolley 9. Usually, although the packages 2 are carried to the game table pit 10 from the backyard 8 in a state of being stored in the cartons CA (refer to FIG. 2*b*), the embodiment is not limited to this, and it is also possible to carry the packages 2 while being placed on the trolley 9 as they are (refer to FIG. 2*c*). The plurality of packages 2 (at least eighteen or thirty-six packages) are stored in each game table pit 10, and are manually carried to the game table 11 from there. When the trolley 9 carries the plurality of cartons CA or packages 2 from the backyard 8 to each game table pit 10, they are carried through a programmed delivery route 13 in the casino 6. In so doing, the trolley 9 holding the cartons CA or the packages 2 is monitored by the management control device 7 by using the camera 12 etc. at a predetermined certain place of the delivery route 13 in the casino 6. In addition, ID code readers 651 and 751 (other reading devices may be used) that read at predetermined timing the carton ID codes 30 of the cartons CA including the packages 2 or the bar codes 3 (as the ID codes) of the packages 2 may be installed inside the trolley 9, and it is also possible to monitor the packages 2 or the cartons CA placed on the trolley 9 by the ID code readers 651 and 751 (refer to FIGS. 2*b* and 2*c*). Further, the trolley 9 may have a structure of having transmission means 655 and 755 for reading at predetermined timing the carton ID codes 30 of the cartons CA including the packages 2 or the bar codes 3 (as the ID codes) of the packages 2, and for transmitting results of the reading to an outside or communicating with the outside. Inside the trolley 9, the plurality of readers 651 and 751 are installed at scanning means 653, 753, and 754, the scanning means 653, 753, and 754 move in an X direction and a Y direction, thereby each reader moves in the X direction and the Y direction, and the carton ID codes 30 of all the cartons CA or the bar codes 3 of the packages 2 that are stored in the trolley 9 always continue to be read. Lids 652 and 752 of the trolley 9 include keys 656 and 756, and the cartons CA and the packages 2 inside the trolley 9 can be prevented from being taken out by locking the keys 656 and 756.

The management control device 7 is achieved by computer equipment (as a management control device having the following functions), and functions of methods and processes are achieved by installing in a computer a program executed by a computer processor. The management control device 7 performs management as follows.

1) A registration step of registering in the database 7*b* all the ID codes 4 of the packages 2 carried to the backyard 8. In order to register all the ID codes 4 of the packages 2 supplied to the casino 6, data from the factory, the carton ID codes 30, or the pallet ID 40 can be used instead of reading all the bar codes 3 of the packages 2 or reading the ID codes 4 by the camera 12 or the RFID tag reading device (not shown). A two-dimensional code reader as a QR Code reader can be used for carrying out the present invention instead of the bar code reader (not shown).

2) A management step of reading all the ID codes 4 of the packages 2 carried to the game table pit 10 by obtaining the respective ID codes 4 of all the existing packages 2 of the shuffled game cards by the ID code readers 451 and 551 (the camera 12 or the other reading device can be used) in the game table pit 10, and of monitoring the respective ID codes 4 of all the existing packages 2 of the shuffled game cards at the game table pit 10.

In the management step in the game table pit 10, it is inspected whether or not all the ID codes 4 of the packages 2 are carried in the backyard 8 for the first time, and are registered in the database 7*b*. An image obtained by the monitoring camera 12 is sent to the management control device 7 by a transmission device (by wired or wireless communication), is analyzed by the management control device 7, and is confirmed as a proof that all the ID codes 4 of all the packages 2 in the image, and the ID codes 4 monitored by the monitoring camera 12 or read by the bar code readers 651 and 751 are actually present in the game table pit 10. The image is obtained by the monitoring camera 12, and is transmitted at predetermined timing (for example, every five minutes, every hour, or the like). The management control device 7 makes all the ID codes 4 of all the existing packages 2 obtained by the monitoring camera 12 or read by the bar code readers 651 and 751 coincide with registered registration ID codes 4 of the packages 2 stored in the database 7*b* at predetermined timing (for example, every five minutes, every hour, or the like) in each game table pit 10. The registration ID codes 4 of the packages 2 in the database 7*b* are basic data considered to be present in the casino 6 as the packages 2 carried (or the packages 2 seem to be carried) to the backyard 8.

The ID codes 4 of the packaged 2 in the game table pit 10 are checked each time when each package 2 reaches the game table pit 10 for monitoring (normally, in a state where the packages 2 are stored in the carton CA) and when the package 2 alone is taken away from the game table pit 10. The packages 2 in the game table pit 10 are monitored by the management control device 7 even at timing decided whether or not the packages 2 are present in the game table pit 10 (for example, every minute, every five minutes, every hour, or every longer time). The storage box 401 can be used to store the plurality of packages 2 (or the cartons CA including the packages) of the shuffled game cards, and to monitor the ID codes 4 (or the carton ID codes 30) attached to the packages in the game table pit 10.

The package 2 present in the game table pit 10 is manually carried to the game table 11 by the dealer (D) etc., and is put on the game table in order to use it for a game (for example, baccarat game). When the shuffled playing cards 1*s* are used for the game at the game table 11, the package 2 is unpacked and is installed in the card shooter device S in order to be able to pull out the shuffled playing cards 1*s* one by one from the card shooter device S (refer to FIG. 1). During the game, the dealer (D) pulls out cards 1 from the card shooter device S, and distributes them to the game table 11.

Just before the package 2 is torn on the game table 11, the ID code 4 of the package 2 is read by the bar code reader R of the card shooter device S in order to authenticate the ID code 4 of the package 2 having used at each game table 11 (the ID code 4 of the package 2 used next is read as mentioned later, and the package 2 is set to be "used"). The registered ID code 4 of the package 2 in the database is deleted from the database 7*b*, or the package 2 is authenticated to have been used at each game table 11 and then registered when selected so as to be used for the next game at the playing table 11, and is read by the bar code reader R. The ID code 4 of the package 2 read to be used next is inspected by the management control device 7 as follows: whether or not the package 2 should be normally present at the game table 11; or by determining the package 2 to be at least one of the following cases, whether or not the package 2 has been delivered at normal timing; whether or not the package 2 is the irregular suspicious one; whether or not the package 2 should be on the game table 11; or whether the package 2 has not arrived at regular timing or for a regular period (it has not arrived at a normal expected time).

1) Whether or not the package 2 has been carried via the predetermined delivery route 13, 2) Whether or not the package 2 is the missing one until now, 3) Whether or not the package 2 has been registered, 4) Whether or not the package 2 has been unused in the game table pit 10 exceeding for a determined period, 5) Whether or not the package 2 has been carried from the unexpected game table pit 10, or whether it has been carried via no game table pit 10, 6) Whether the package 2 is not used at any game table 11 in the past.

The ID code reader (the bar code reader R is included) is connected to a control device 112 on the game table 11. The suspicious package 2 is detected by the management control device 7 from inspection results of the ID code 4 of the package 2. Presence of the suspicious package 2 is reported to the card shooter device S (or the other shuffle device etc.) so that the detected suspicious package 2 is not used. The card shooter device S may include output means of alarm or a notice based on the inspection results of the ID code 4 of the package 2 in order not to use the suspicious package 2, or to stop further use of the package 2. The management step may further include a step of managing whether or not all the registered ID codes 4 of the packages 2 in the database 7*b* have been erased, or whether or not the packages 2 have been authenticated to be used at any game table 11 for a certain fixed period (whether or not there are any packages 2 not used at the game table for the certain fixed period (one week, one month, or the like). The ID code reader R is directly or indirectly connected to the card shooter device S on the game table 11, and is configured so as to send the ID code 4 of the package 2 to the management control device 7 in order to identify the ID code 4 of the package 2 to be used next, and the card shooter device S receives a command from the management control device 7.

The management control device 7 collates all the ID codes 4 of all the existing packages 2 or the packages 2 included in the carton CA that have been obtained by the readers 451 and 551 in each game table pit 10 with the registration ID codes 4 of the packages 2 in the database 7*b* at predetermined timing (every five minutes, every hour, or the like). The registration ID codes 4 of the packages 2 in the database 7*b* are basic data considered to be present in the casino 6 as the packages 2 carried (seem to be carried) to the backyard 8. All the ID codes 4 of all the existing packages 2 or the packages 2 included in the carton CA that have been obtained by the readers 451 and 551 in each game table pit 10 are collated with the registration ID codes 4 of the packages 2 in the database 7*b*, whereby monitoring of all the package 2 present in the game table pit 10 or the packages 2 included in the carton CA is performed at determined timing (every five minutes, or not more than or not less than that). The management control device 7 can check whether or not there are remaining packages 2 missing or considered not to be present in the game table pit 10. The management control device 7 may report results of the above-described management (collation results thereof) to a management department of the casino 6.

In monitoring and obtaining of the ID codes 4, it can be confirmed whether or not all the registration ID codes 4 of the packages 2 of the shuffled playing cards have been deleted for appropriate timing, with the shuffled playing cards being determined to be used ones after the end of the game, by comparing all the ID codes 4 with the ID codes 4 of the new packages 2 carried to the backyard 8. If one of the ID codes 4 of the packages 2 is not deleted, or is not authenticated to be used, it means that the casino has inappropriate or suspicious stock.

The image obtained by the monitoring camera 12 may be analyzed by the management control device 7 as follows.

1) All the bar codes 3 relating to the ID codes 4 of all the packages 2 in the image are recognized.

2) The bar codes 3 identified by a bar code reading program are read as the ID codes 4.

3) Each ID code 4 is registered together with a read place as a proof of the presence of the packages 2 at predetermined timing, such as every five minutes or every hour.

4) All the ID codes 4 of all the existing packages 2 obtained by the monitoring camera 12 are collated with the registration ID codes 4 of the packages 2 stored in the database 7*b*.

5) In the database, it is calculated whether or not all the registration ID codes 4 of the packages 2 considered to have been carried to the backyard 8 and to have been present in the casino 6, or whether or not the ID codes 4 of the packages 2 remain.

6) The management control device 7 may report results of the above-described management to the management department of the casino 6.

The calculated ID codes=all the ID codes 4 of the packages 2 carried to (unloaded in) the backyard 8 and registered—(minus) all the ID codes 4 of the packages 2 obtained by the camera 12 or the bar code readers R, 451, 551, 651 and 751 also including the ID codes 4 erased or authenticated to be used. These calculations are performed at all places (all in the backyard 8, in the game table pit 10, at the game table 11, and on the trolley 9 of each place). The ID codes 4, the number of the packages lost after the presence of the packages has been confirmed, places where the lost packages have been present (last places where the presence of the packages have been confirmed) are reported. Monitoring results etc. of missing, the remaining ID codes 4, and the number of the other existing packages may be displayed by a monitor display 60 in the management department etc.

In these steps of managing the packages 2 of the shuffled playing cards, each ID code 4 of the packages 2 on the delivery route 13, and all the trolleys 9 that carry the packages 2 or the cartons CA from the backyard 8 may be monitored by the camera 12, and further, it is also possible to decide a place of the trolley 9 by a sensor (not shown), and to control the trolley 9 by an automatic conveying vehicle system known as an AGV system technology.

The management control device 7 is programmed to monitor each ID code 4 of the actual package 2. In addition, the management control device 7 calculates and registers each individual ID code 4 at all places based on the places from all the existing actual ID codes 4, and information obtained and analyzed by the camera 12 and the management control device 7, and thereby registration IDs of the respective places obtained by the monitoring camera are compared with each other, whereby the lost ID codes 4 can be recognized.

The method further includes a monitoring step of managing the number of all the existing packages 2 of the shuffled playing cards in the backyard 8, and the game table pits 10 and the game tables 11 of all the play tables, and grasping whether or not the packages on the trolley 9 are lost during a carrying step by comparing all the actual ID codes 4 on the respective trolleys 9 with information of all the ID codes of the packages obtained when the packages are carried to the backyard 8.

The management step is very important for safe operation of the casino. All the existing actual ID codes 4 are compared with information of the ID codes 4 of all the packages obtained when the packages 2 are carried to the backyard 8 (or all the game table pits 10 or game tables 11 of the playing tables), and thereby it is recognized whether or not there is a lost package or an additional package at all the places. As a result, all the actual packages 2 of the shuffled playing cards are managed in the backyard 8, in all the game table pits 10 or game tables 11 of the playing tables, and thereby it is ensured that all the packages in the casino are controlled.

Before the shuffled playing cards 1*s* are set in the card shooter device S, a cut card 1*c* is inserted thereinto. The cut card 1*c* is inserted into a latter half (the remaining portion is approximately one-quarter or one-fifth) of the shuffled playing cards 1*s* when used for the game. In order to prevent that ranks of the respective cards 1 distributed during the game are counted by players etc., and that ranks of the cards that have not been drawn yet are predicted when they run short, the cut card 1*c* is used to end the game in a state where approximately twenty to forty cards are left in the card shooter device S. Usually, when the cut card 1*c* is drawn during the game, use of the currently used shuffled playing cards 1*s* is canceled after the game or a little after the game, and the game is ended. The shuffled playing cards 1*s* in the card shooter device S are exchanged for a new set, and a game is newly started.

In the example, the game table pit 10 is installed at the side of the game table 11, and includes a storage box 401. The package 2 used in a next game is housed in the storage box 401, and the dealer (D) takes out the package 2 used in the next game from the storage box 401, and sets the shuffled playing cards 1*s* in the card shooter device S. Therefore, the storage box 401 is put beside the dealer (D) at the side of the game table 11.

Figure 11:
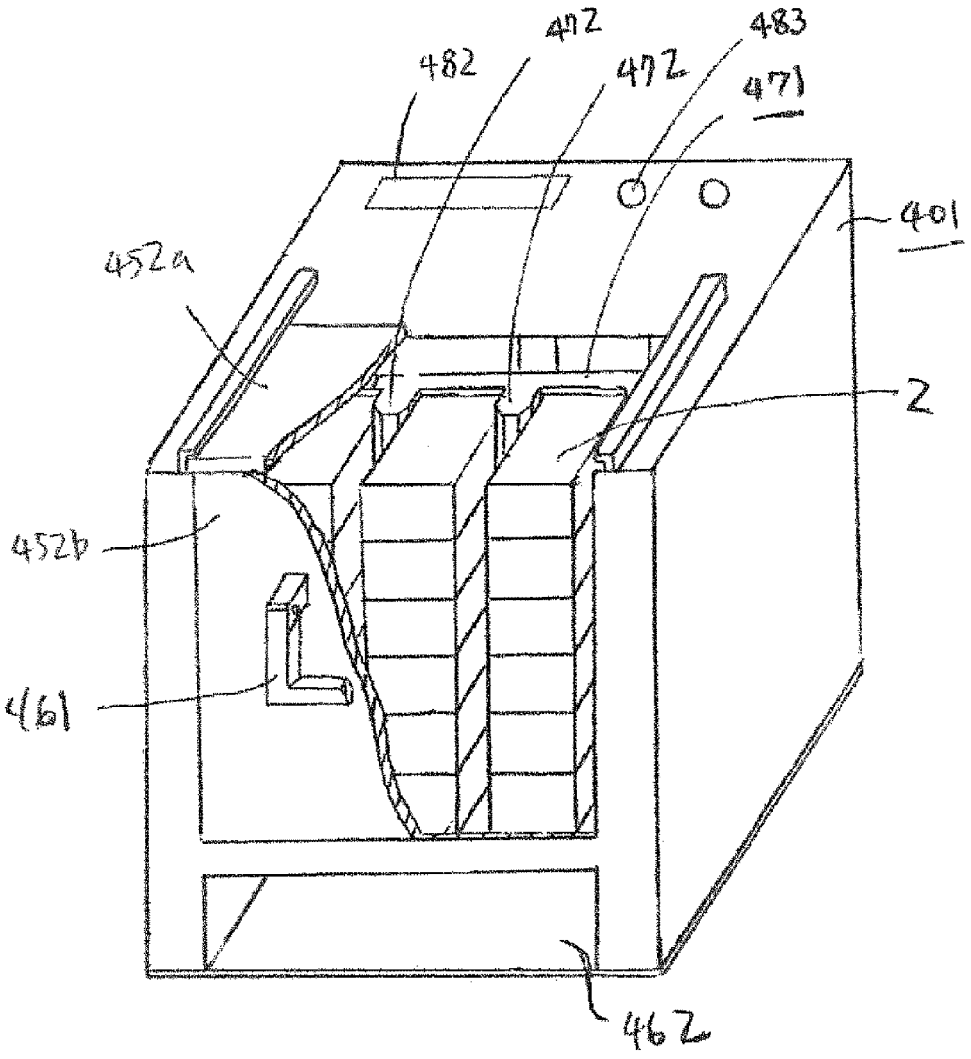
FIG. 11 is a perspective view of the storage box of the same embodiment in a state where the packages are set.

In addition to the storage box 401, a carton cabinet 501 that stores the cartons CA may be further included. The plurality of (eighteen) packages 2 used in games from the next time are stored in the storage box 401 (refer to FIG. 11). The unopened carton CA including the plurality of (eighteen) packages 2 is stored in the carton cabinet 501 (refer to FIG. 5). The carton ID code 30 is attached to the carton CA, and the carton ID code 30 attached to the carton CA always continues to be read by the reader 551 installed in the carton cabinet 501. The carton CA stored in the carton cabinet 501 is taken out from the carton cabinet 501 in order to be used in the next game after all the packages 2 in the storage box 401 are used, the whole carton CA is moved to the storage box 401 of the game table pit 10, and the packages 2 in the carton CA are used for the game.

Next, there will be explained a method for housing the carton CA into the storage box 401, and a method for taking out the packages 2 used in the next game from the storage box 401.

Figure 6:
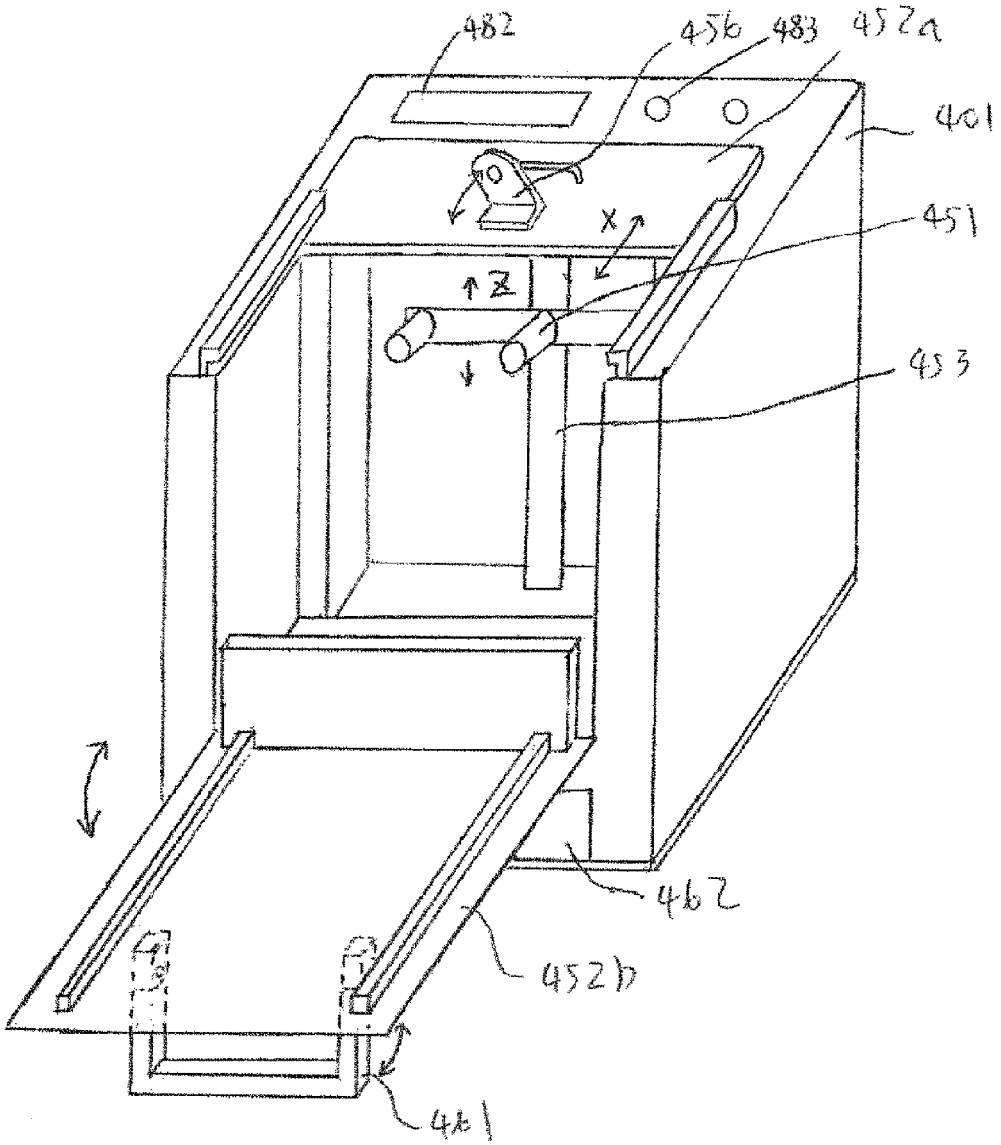
FIG. 6 is a perspective view of the storage box of the same embodiment in a state where a lid is opened.

After all the packages 2 in the storage box 401 are used, a top lid 452*a* is opened, a leg 461 of a rotary lid 452*b* is pulled out to the front, the rotary lid 452*b* is rotated by 90 degrees to make it parallel to a floor surface, and the leg 461 of the rotary lid 452*b* is stood vertically to a floor surface (refer to FIG. 6).

Figure 7:
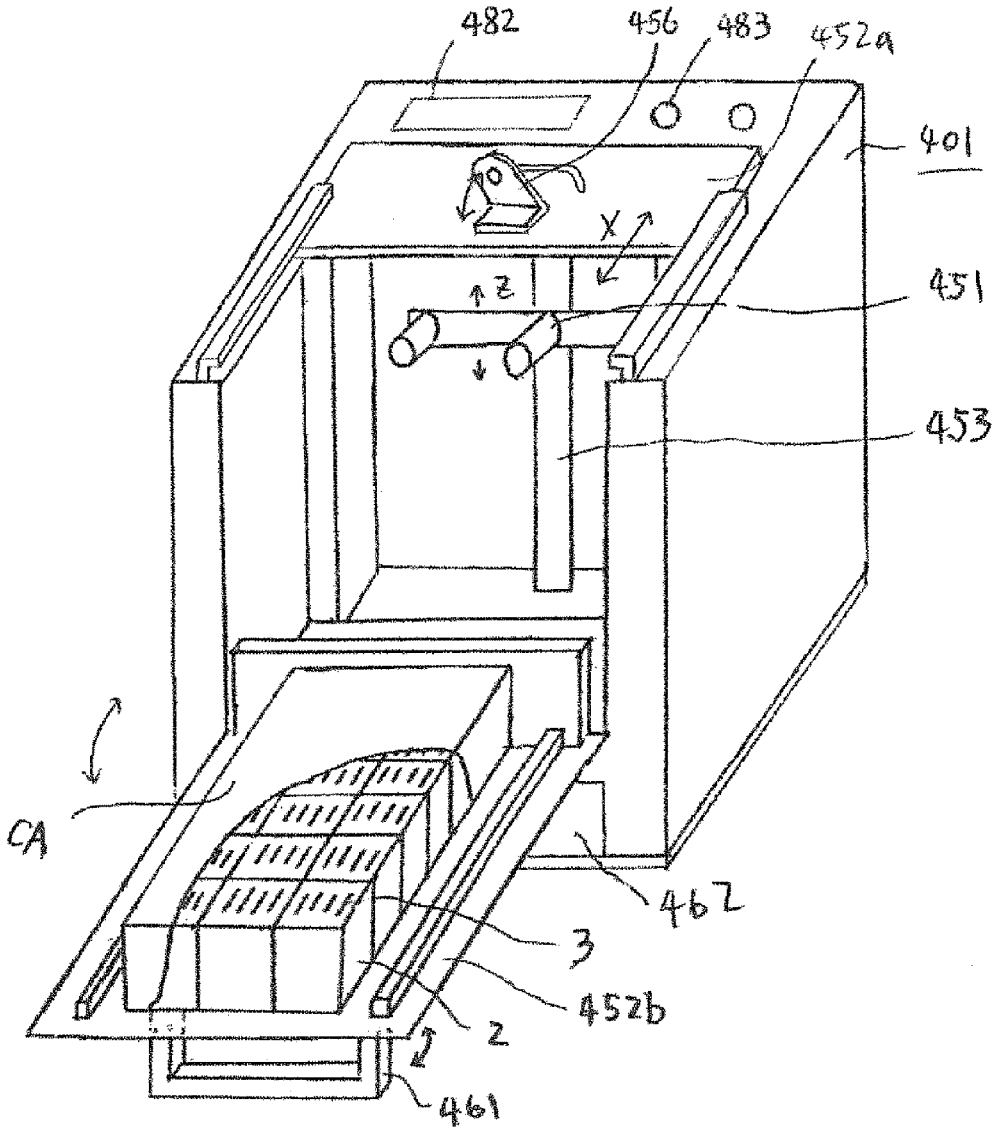
FIG. 7 is a perspective view of the storage box of the same embodiment showing a state where a carton has been set.
Figure 8:
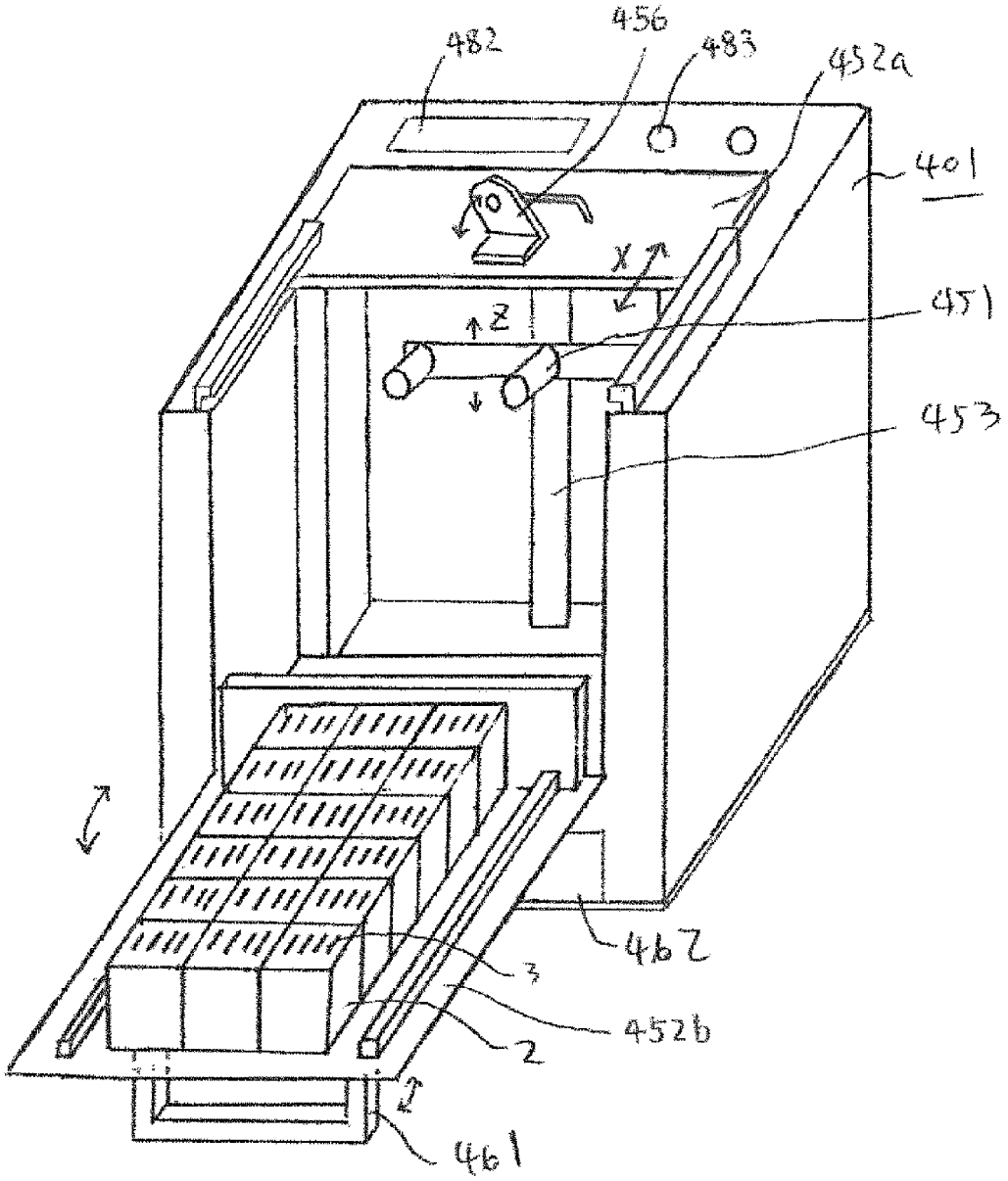
FIG. 8 is a perspective view of the storage box of the same embodiment in a state where packaging of the carton has been removed.
Figure 9A:
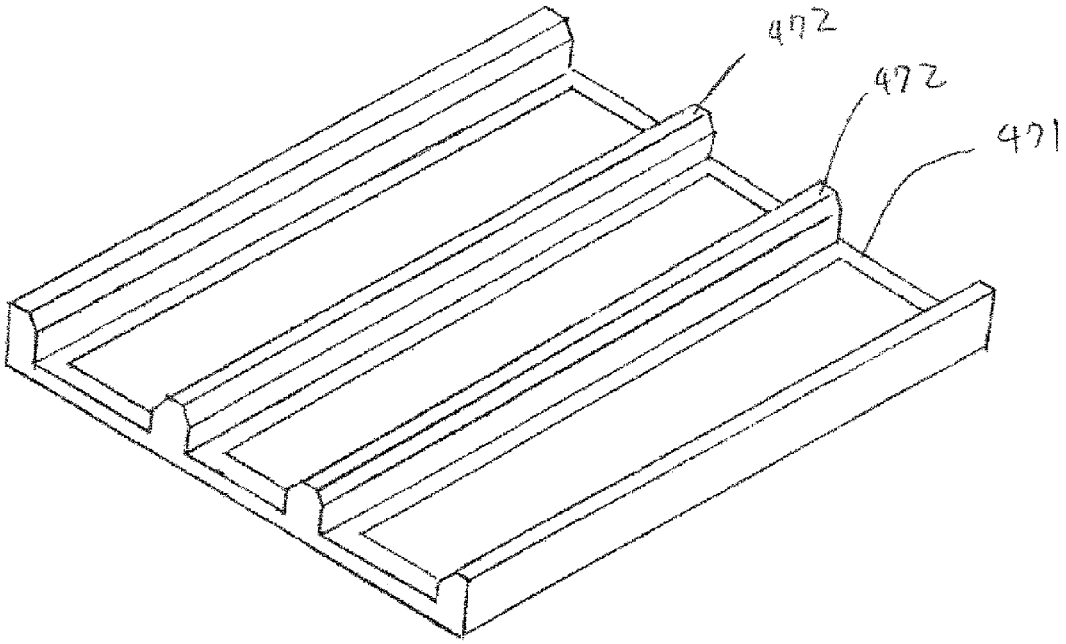
FIG. 9*a* is an enlarged perspective view of a partition plate of the same embodiment.
Figure 9B:
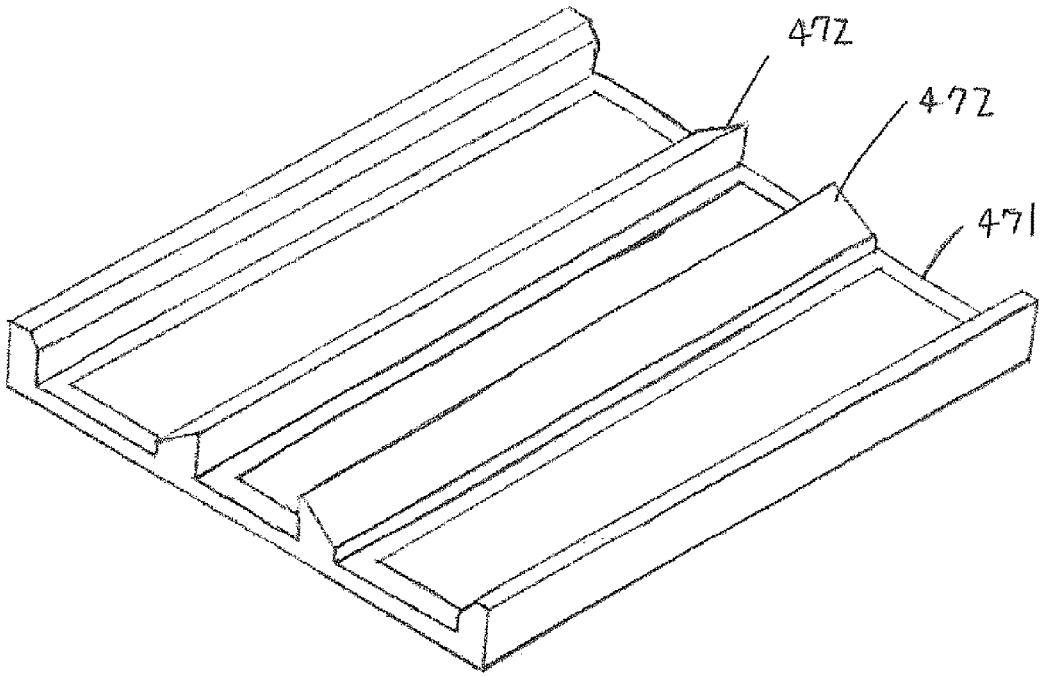
FIG. 9*b* is an enlarged perspective view of the partition plate of the same embodiment.
Figure 10:
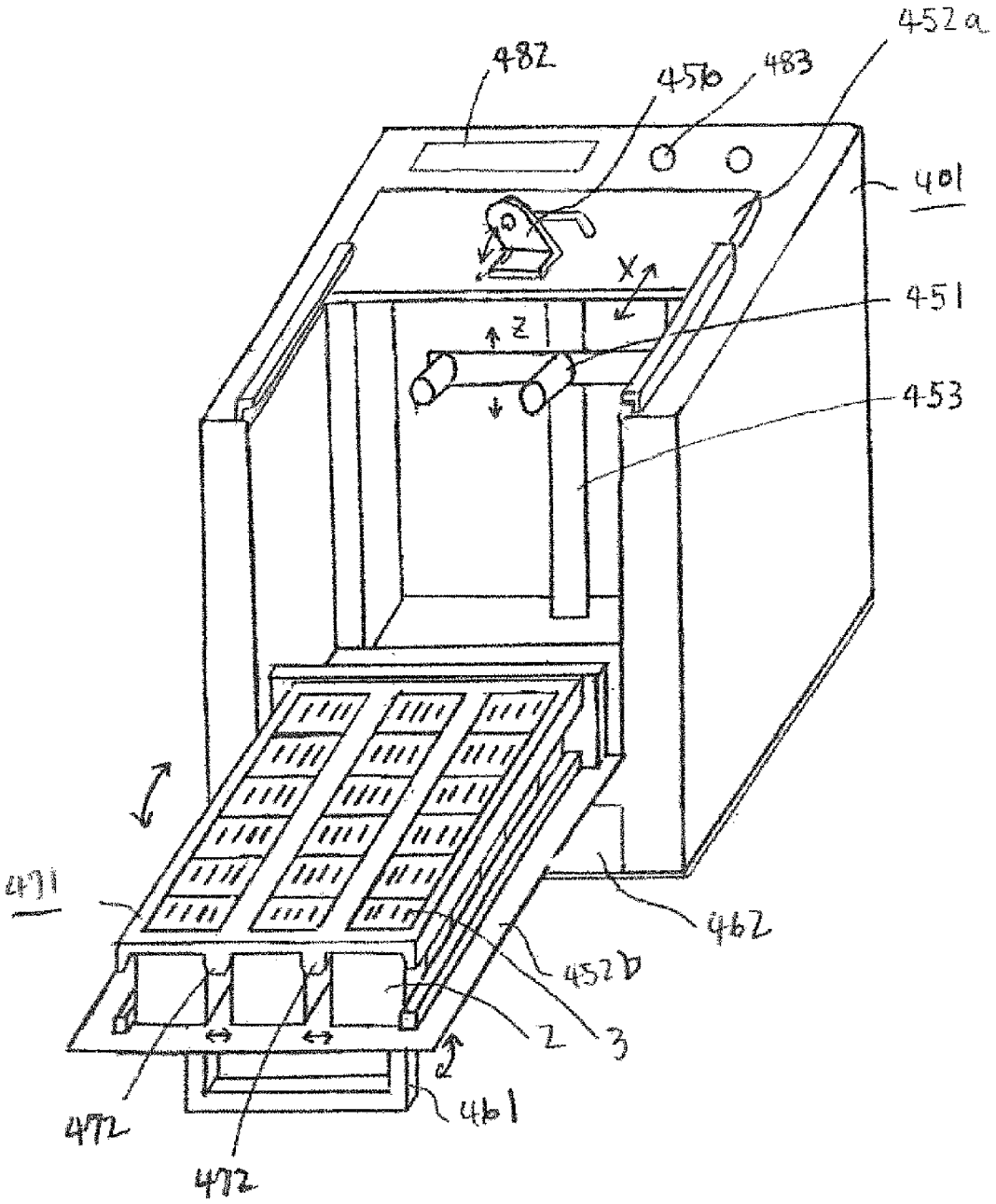
FIG. 10 is a perspective view of the storage box of the same embodiment in a state before the packages are set.

In a state where the rotary lid 452*b* is made parallel to the floor surface, the carton CA taken out from the carton cabinet 501 is installed on a back surface of the rotary lid 452*b* (refer to FIG. 7). At this time, the carton CA is installed so that the ID codes 4 attached to the packages 2 included in the carton CA appear on upper surfaces of the packages 2. Packaging of the carton CA is removed, and the ID codes 4 attached to the packages 2 are exposed (refer to FIG. 8). Next, gaps are formed between lines of the arranged packages 2, projections 472 of a partition plate 471 are fitted in the gaps, and the partition plate 471 is installed on the upper surfaces of the packages (refer to FIGS. 9 and 10). Hereby, since a state where the gaps are present between the packages 2 can be kept, there is an effect of making each package 2 easily taken out from the storage box 401 later. Here, tips of the projections 472 of the partition plate 471 are each formed in a pointed shape, and thereby it becomes possible to easily fit them between the packages 2 (refer to FIG. 9*b*).

Next, the rotary lid 452*b* is rotated by 90 degrees to thereby be returned to an original position. The top lid 452*a* is then closed (refer to FIG. 11). The plurality of readers 451 are installed at scanning means 453 inside the storage box 401, each reader moves in a Z direction by the scanning means 453 moving in the Z direction, and the ID codes 4 of all the packages 2 stored in the storage box 401 always continue to be read (refer to FIG. 10).

Figure 12:
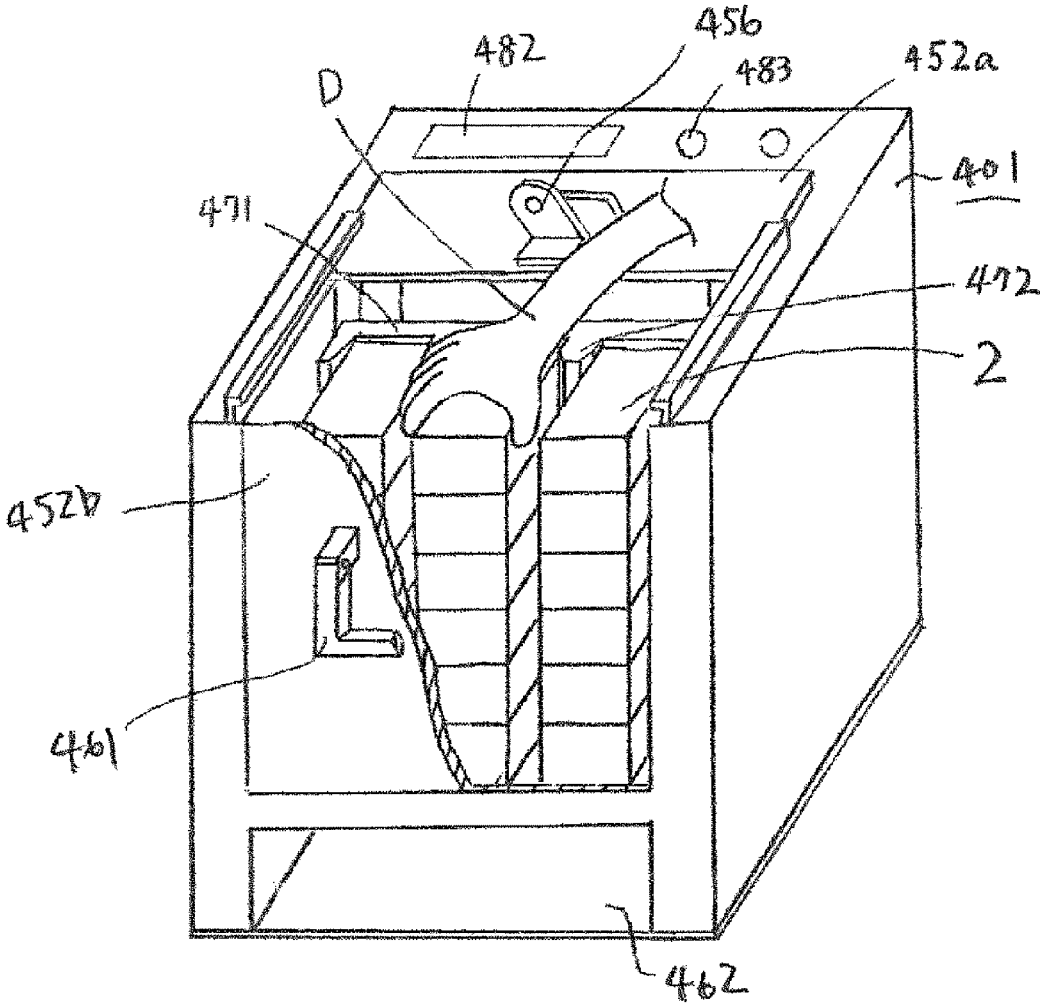
FIG. 12 is a perspective view of the storage box in the same embodiment showing a state where the packages are taken out from the storage box one by one.

The game is ended as described above, and in order to newly begin a game, the dealer (D) exchanges a set of the shuffled playing cards 1*s* in the card shooter device S for a new set. In order to exchange for the new set, the dealer (D) opens the top lid 452*a* of the storage box 401, and takes out the package 2 stored in the storage box 401 by his hand (refer to FIG. 12). Next, the dealer (D) reads the ID code 4 of the package 2 newly taken out from the storage box 401 by the reader R included in the control device 112, opens the package 2, and sets the shuffled playing cards 1*s* in the card shooter device S (refer to FIG. 1).

As mentioned above, since the ID codes 4 of all the packages 2 stored in the storage box 401 always continue to be read by the reader 451 in the storage box 401, it is grasped which package 2 having which ID code 4 was taken out when the dealer (D) takes out the package 2 from the storage box 401. It is determined whether or not the grasped ID code 4 and the ID code 4 of the package 2 used next read by the reader R included in the control device 112 coincide with each other, whereby it can be confirmed whether or not the package 2 taken out from the storage box 401 at the last minute is the package 2 used for the next game by the card shooter device S.

Keys 456 and 556 are included in a lid 552 of the carton cabinet 501 and the top lid 452*a* of the storage box 401, and the packages 2 in the storage box 401 and the carton CA in the carton cabinet 501 can be prevented from being taken out by locking the keys 456 and 556. In addition, a gap 462 is provided in a lower part of the storage box 401, and packaging materials removed from the cartons CA can be temporarily stored.

Results of continuing to read the carton ID code 30 of the carton CA stored in the carton cabinet 501 by the reader 551, and results of continuing to read the ID codes 4 of the packages 2 stored in the storage box 401 by the reader 451 are reported to the management control device 7 through the control device 112.

Figure 5:
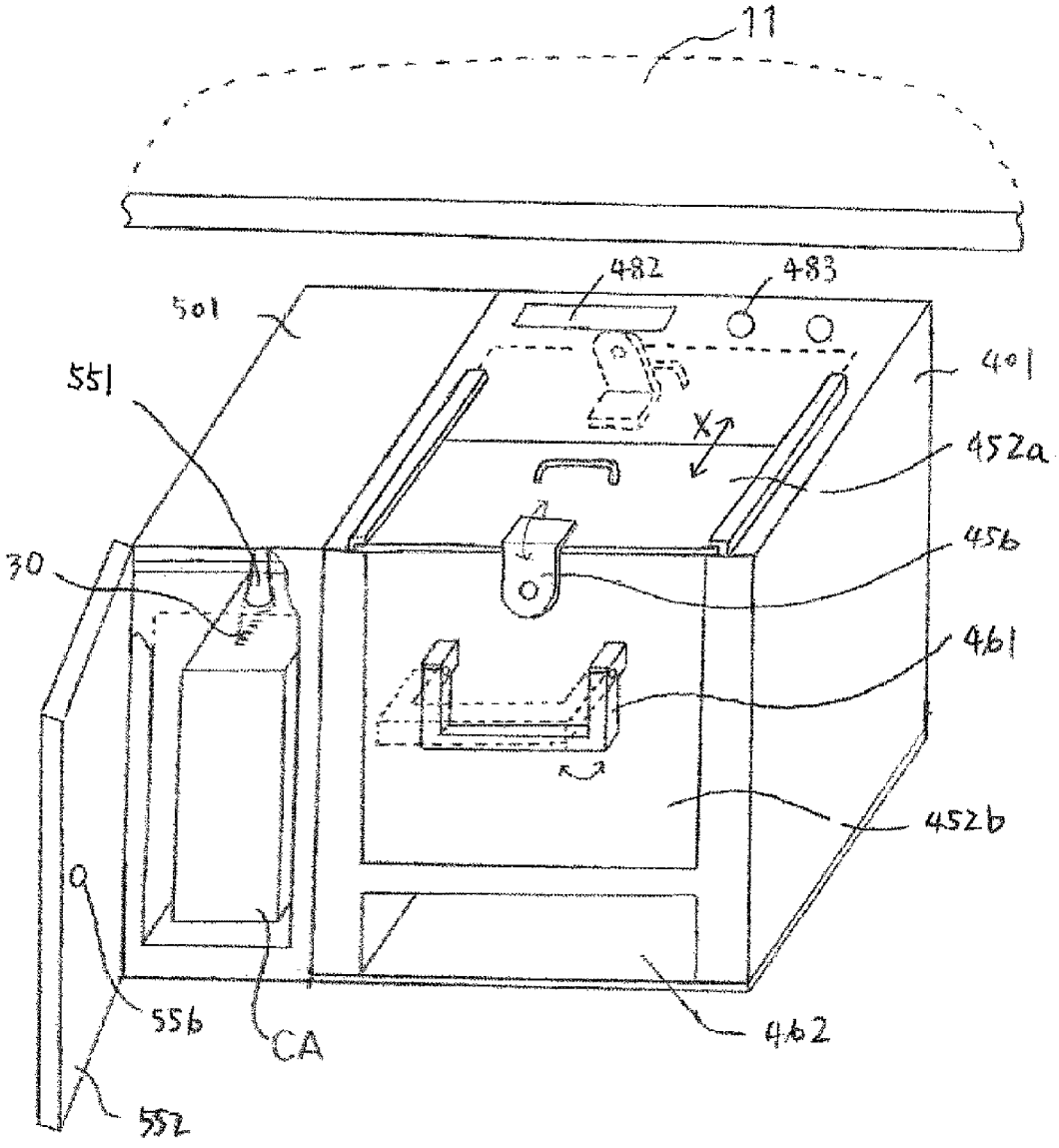
FIG. 5 is a perspective view showing an outline of the storage box and a carton cabinet of the embodiment of the present invention.

Further, means for displaying the reading results of the ID codes 4 of the packages 2 stored in the storage box 401 and the reading results of the carton ID code 30 of the carton CA stored in the carton cabinet 501 (a storage box lamp 483, a storage box monitor 482, etc.) may be provided in the storage box 401 and the carton cabinet 501 (refer to FIG. 5 etc.). Furthermore, it is also possible to display on the storage box monitor 482 the results of management by the management control device 7, and a message sent from the management department. Note that the means for displaying the reading results, such as the storage box lamp 483 and the storage box monitor 482 may be installed at a place for the dealer (D) to easily see during the game, for example, near the top lid 452*a*.

Although the suitable embodiment of the present invention considered at present has been explained hereinbefore, it is understood that various deformations can be made to the embodiment, and it is intended that the accompanying claims include such all the deformations within the true spirit and the scope of the present invention.

The invention claimed is:

1. A system for managing packages of shuffled playing cards, comprising:

packages of shuffled playing cards in which playing cards included in a predetermined number of decks are shuffled in random order and are individually packed in one package, and in which a unique ID code is given to each unique package of the shuffled playing cards;

a game table at which a game is performed using the shuffled playing cards;

a storage box that is associated with the game table, stores the plurality of packages, includes one or more readers that read the ID codes of all the packages, and includes an openable portion so that the packages can be taken out one by one; and a control device for monitoring whether or not the packages are present in the storage box by monitoring the ID codes of the packages read by the readers, and for outputting monitoring results.

2. The system for managing the packages of the shuffled playing cards according to claim 1, wherein the storage box includes locking means configured to prevent taking-out of the packages from the storage box.

3. The system for managing the packages of the shuffled playing cards according to claim 1, wherein the storage box includes a rotary side lid with a leg.

4. The system for managing the packages of the shuffled playing cards according to claim 1, the system further comprising:

a carton in which the predetermined number of packages are packed, and to which a unique carton ID code is given; and a carton cabinet to store the carton that has one or more readers that read the carton ID code, wherein the control device monitors whether or not the carton is present in the carton cabinet by monitoring the carton ID code read by the readers, and outputs monitoring results.

5. The system for managing the packages of the shuffled playing cards according to claim 4, wherein the carton cabinet includes locking means configured to prevent taking-out of the packages from the storage box.

6. The system for managing the packages of the shuffled playing cards according to claim 4, wherein the carton cabinet is installed beside a game table.

7. A storage box that stores packages of shuffled playing cards and monitors ID codes given to the packages, the storage box comprising:

a carton cabinet that stores the plurality of packages, includes one or more readers that read the ID codes of all the packages, and includes an openable portion so that the packages can be taken out one by one; and a control device for monitoring whether or not the packages are present in the storage box by monitoring the ID codes of the packages read by the readers, and for outputting monitoring results.

8. The storage box that stores the packages of the shuffled playing cards and monitors the ID codes given to the packages according to claim 7, wherein the storage box includes locking means configured to prevent taking-out of the packages from the storage box.

9. The storage box that stores the packages of the shuffled playing cards and monitors the ID codes given to the packages according to claim 7, wherein the storage box includes a rotary side lid with a leg.

10. A package of shuffled playing cards for use in a system for managing one or more packages of playing cards, comprising:

a predetermined number of decks of playing cards that are each randomly shuffled and are individually packed in the package, the package configured to be stored in a storage box of the system associated with a gaming table, the storage box configured to store the one or more packages of playing cards and enable one by one removal of the one or packages from the storage box via an openable portion of the storage, and a unique ID code given to the package of shuffled playing cards, the unique ID code configured to enable one or more readers included in the storage box to read the unique ID code, the one or more readers configured to read IDs of the one or more packages such that a control device of the system for monitoring the ID codes read by the one or more readers is enabled to determine which packages are present in the storage box and output a monitoring result.

11. A system for managing packages of shuffled playing cards, comprising:

packages of shuffled playing cards in which playing cards included in a predetermined number of decks are each uniquely shuffled in random order and are individually packed in one package, and in which a unique ID code is given to each unique package of the shuffled playing cards;

a game table at which a game is performed using the shuffled playing cards;

a storage box that is associated with the game table, stores the plurality of packages, and includes one or more readers that read repeatedly the ID codes of all the packages; and a control device for monitoring whether or not the packages are present in the storage box by repeatedly collating the ID codes of the packages read by the readers with registered ID codes of the packages in a database.

12. The system for managing the packages of the shuffled playing cards according to claim 11, wherein the system further includes a displaying means that displays a result corresponding to a determination by the control device of whether or not the packages are present in the storage box.

13. The system for managing the packages of the shuffled playing cards according to claim 11, wherein the storage box includes locking means configured to prevent taking-out of the packages from the storage box.

14. The system for managing the packages of the shuffled playing cards according to claim 11, wherein the storage box includes an openable portion so that the packages can be taken out one by one.

15. The system for managing the packages of the shuffled playing cards according to claim 11, the system further comprising:

a carton in which the predetermined number of packages are packed, and to which a unique carton ID code is given; and a carton cabinet to store the carton that has one or more readers that read the carton ID code, wherein the control device monitors whether or not the carton is present in the carton cabinet by monitoring the carton ID code read by the readers, and outputs monitoring results.

16. The system for managing the packages of the shuffled playing cards according to claim 15, wherein the carton cabinet includes locking means configured to prevent taking-out of the packages from the storage box.

17. The system for managing the packages of the shuffled playing cards according to claim 15, wherein the carton cabinet is installed beside a game table.

18. The system for managing the packages of the shuffled playing cards according to claim 11, wherein the storage box is placed under the game table.

* * * * *